US005309662A

United States Patent [19]

Goodwin et al.

[11] Patent Number: 5,309,662

[45] Date of Patent: May 10, 1994

[54] ALIGNMENT GUIDE

[75] Inventors: David H. Goodwin, Hollis; Richard W. Cressey, Biddeford, both of Me.

[73] Assignee: Saco Defense Inc., Saco, Me.

[21] Appl. No.: 991,839

[22] Filed: Dec. 16, 1992

[51] Int. Cl.[5] ..... F41A 9/79

[52] U.S. Cl. ..... 42/105; 89/34; 89/33.01

[58] Field of Search ..... 42/105; 89/33.01, 33.05, 89/33.1, 33.17, 34, 45, 35.01

[56] References Cited

U.S. PATENT DOCUMENTS

| | | | |
|---|---|---|---|
| 1,224,366 | 5/1917 | Driggs | 89/33.01 |
| 2,335,449 | 11/1943 | Salisbury | 89/35.01 |
| 3,032,907 | 5/1962 | Parker | 89/34 |
| 3,563,132 | 2/1971 | Cashen et al. | 89/33.14 |
| 3,568,349 | 3/1971 | Lanizzani | 42/105 |
| 5,052,144 | 10/1991 | Ostor | 42/105 |

FOREIGN PATENT DOCUMENTS

| | | | |
|---|---|---|---|
| 669253 | 2/1989 | Switzerland | 89/33.01 |

*Primary Examiner*—Stephen M. Johnson
*Attorney, Agent, or Firm*—William Nitkin

[57] ABSTRACT

An improved alignment guide for use in the MK-19 grenade launcher of the type having a body member with a centrally located slot defined therein extending to a bowl formed in the body member, the guide being characterized by a lack of upper and lower edge rails and having a single body aperture formed therein between its central screw aperture and the bowl, the body member around the bowl being approximately 0.25 inch thick with a thickened arm provided at the end of the body member beyond the bowl, such thickened arm being approximately 0.5 inch thick, such alignment guide having the same interface dimensions as that of the prior art alignment guide to allow the alignment guide of this invention to be engaged into the receiver of an MK-19 grenade launcher.

2 Claims, 2 Drawing Sheets

ALIGNMENT GUIDE

BACKGROUND OF THE INVENTION

1. Field of the Invention

The structure of this invention is an alignment guide and more particularly relates to an alignment guide for use in an MK-19 grenade launcher for positioning rounds in the receiver assembly for the delinking and pickup thereof by the bolt extractors of such weapon.

2. Description of the Prior Art

At the front of the receiver assembly of an MK-19 grenade launchers is an alignment guide which has a slot defined therein that receives the ogive portion of each of the rounds as they are entered into the weapon, such rounds being linked to one another. The rounds are advanced with their ogive portions riding in the slot and with the lengths of their bodies perpendicular to the alignment guide. When each round reaches the position for its delinking, it is positioned in front of a bowl-shaped aperture in the alignment guide, hereinafter referred to as the "bowl." The round is advanced into the bowl and then retracted, causing the round to be delinked from the next adjacent round. The round is retained at its rear rim by the bolt extractors. The edge of the bowl of the alignment guide is sharp due to the fact that the increasing width of the bowl at its top nearly coincides with the outside width of the alignment guide, resulting in an area of stress concentration. After the round is pulled rearward by the bolt extractors, it is moved to its firing position. At the top and bottom of the alignment guide are rail members. A center hole is provided for a spring attachment screw. First and second body apertures are provided on each side of the member containing the center hole. The body of the prior art alignment guide is thickened in most of the area around the bowl which configuration causes the edge of the bowl to contact the ogive of the round. The features of the edge rails, thickened body around the bowl and body apertures are initially cast into the structure of the prior art alignment guide. Because of the thickness and resulting weight of the body of the prior art alignment guide, a pair of elongated slots are cut in the rear of the prior art alignment guide to diminish the weight of the structure. All of the above-mentioned features of the prior art alignment guide necessitate a great deal of machining to be performed on the casting to manufacture such prior art alignment guide.

SUMMARY OF THE INVENTION

It is an object of this invention to provide a simplified alignment guide which performs all of the functions of the prior art alignment guide but which is less expensive to manufacture and which reduces the stresses around the sharp edge formed at the front of the bowl of the prior art alignment guide. To this end the upper first edge rail and bottom second edge rail of the prior art alignment guide are omitted along with their equivalent thickness at the front of the thickened area around the bowl. The result of this first step is to make the alignment guide body thinner around the bowl with such bowl being shallower than the bowl of the prior art alignment guide. By lessening the depth of the bowl, the stress at the edges of the bowl is lessened as there is more distance now between the edge of the bowl and the sides of the alignment guide and the ogive of the shell moves therein a shorter distance. The alignment guide of this invention still functions as well as the prior art alignment guide as far as the firing of the weapon. In addition to the first step discussed above, in the improved alignment guide of this invention the first body aperture is totally eliminated. Thus, the only body aperture in the alignment guide of this invention is in the position of the second body aperture of the prior art alignment guide. The body aperture of this invention still allows for the spring member to be attached to the center hole spring attachment screw engaging into the pin. Since the body of the alignment guide is now thinner and consequently lighter, the first and second rear slots formed on the prior art alignment guide to lighten the prior art structure are no longer necessary and are also omitted in the present invention. The thickened area of the alignment guide of this invention is limited to the area immediately beyond the end of the bowl which feature still allows the alignment guide of this invention to be properly positioned within the receiver.

Figure 3:
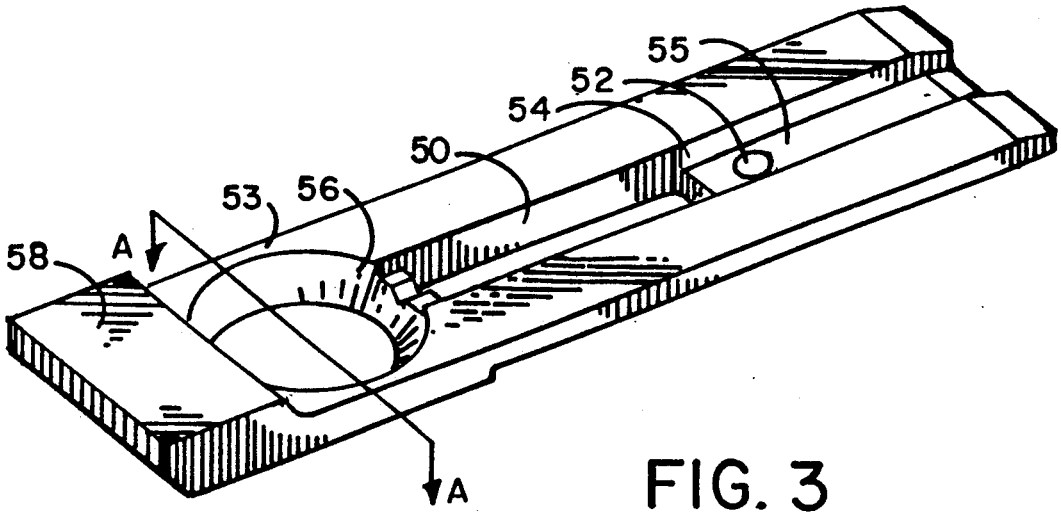
FIG. 3 illustrates a perspective view of the improved alignment guide of this invention.

FIG. *3a* illustrates a cross-sectional view through A—A of FIG. 3.

Figure 4:
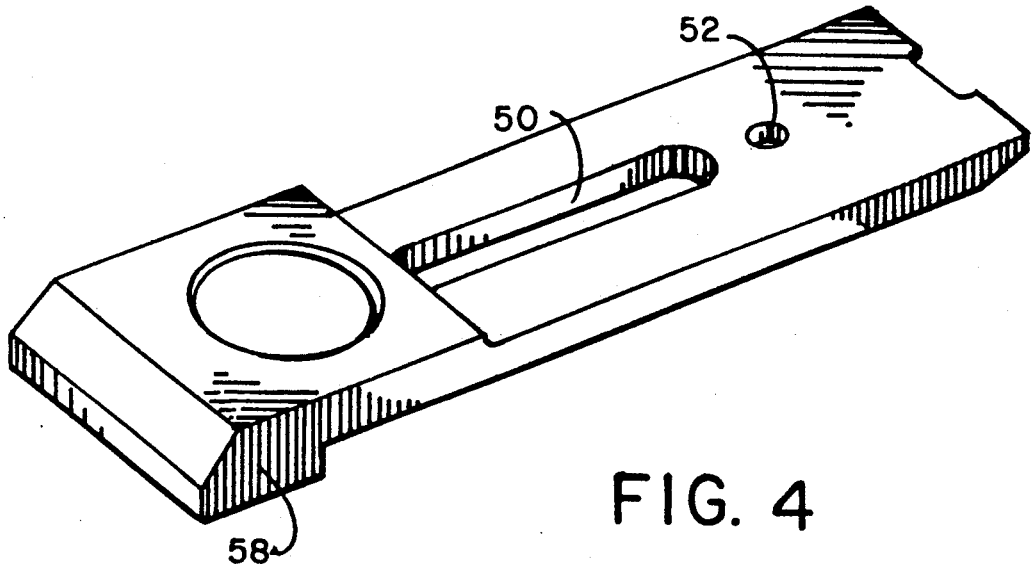

FIG. 4 illustrates a perspective rear view of the improved alignment guide of this invention.

DESCRIPTION OF THE PREFERRED EMBODIMENT(S)

Figure 1:
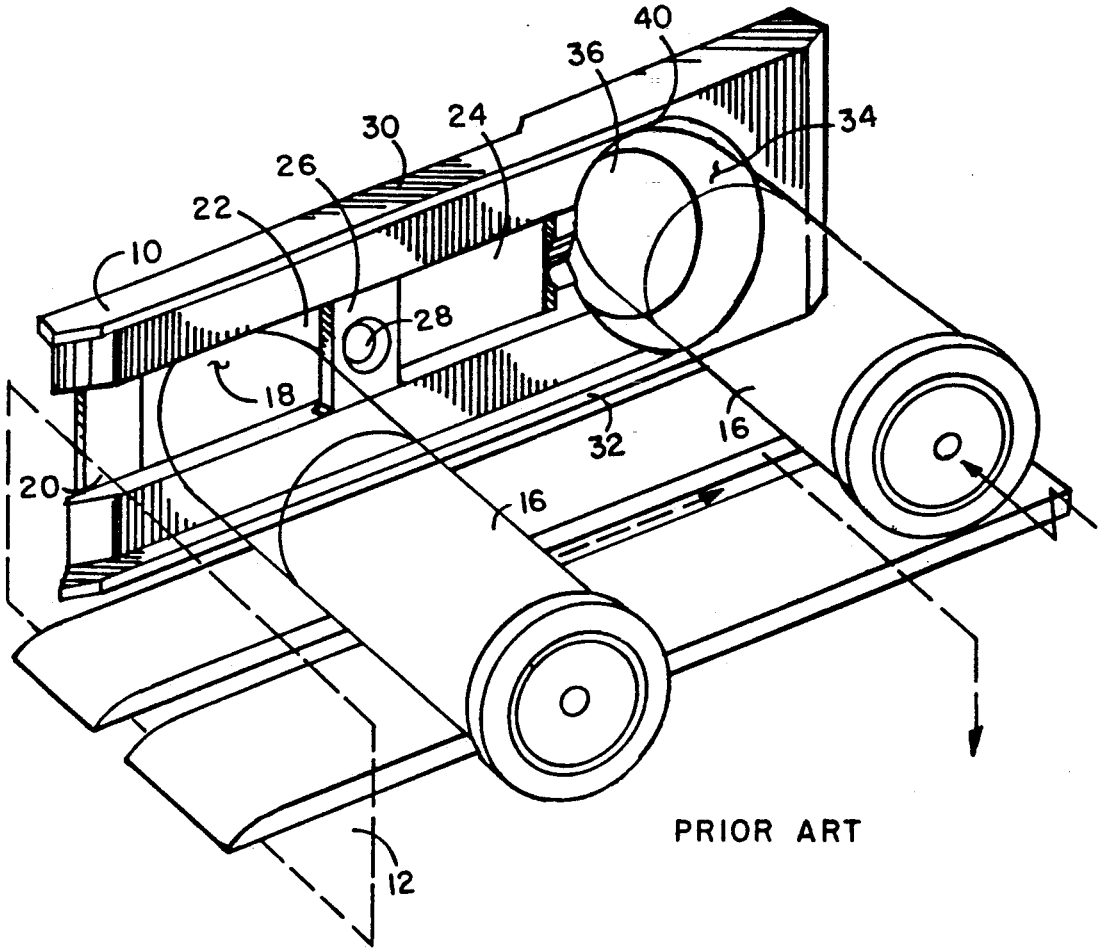
FIG. 1 illustrates a perspective view of the prior art alignment guide in position in an outlined receiver with two rounds shown not linked to one another.

FIG. 1 illustrates the prior art alignment guide 10 used in the MK-19 grenade launcher. Seen in this view is a portion of receiver 12 shown in outline form with base 14 into which rounds 16 are fed. In actual use of the MK-19 grenade launcher, these rounds are interlinked to one another but for clarity of illustration the rounds are not shown linked to one another since linking is well known in the art. The remainder of the weapon is not illustrated but is well known in the art. The round passes, with its ogive 18 channeled within center slot 20, down alignment guide 10. A first body aperture 22 and second body aperture 24 are formed on both side of member 26 containing the center hole spring screw attachment aperture 28. On the top and bottom sides of the alignment guide are first edge rail 30 and second edge rail 32. At the end of alignment guide 10 is bowl 34 which has a bowl aperture 36 formed at its rear end. The ogive of each round 16 during the delinking process is advanced slightly forward by the bolt extractors, not seen in this view but which are well known in the art, which grasp round 16 around its rear rim 38. By moving the round slightly forward and then rearward, the shell is aligned and delinked from the next adjacent round, not shown in this view. Such delinked round is then moved into its firing position by other mechanisms in the MK-19 grenade launcher. The body of the prior art alignment guide is approximately 0.5 inch thick. In this prior art guide, edge 40 of bowl 34 is thin as it is very close to the side of the alignment guide and tends to become sharpened by the action of repetitive round ogive movement therein. This thin, sharpened edge causes stress to be increased within the alignment guide.

Figure 2:
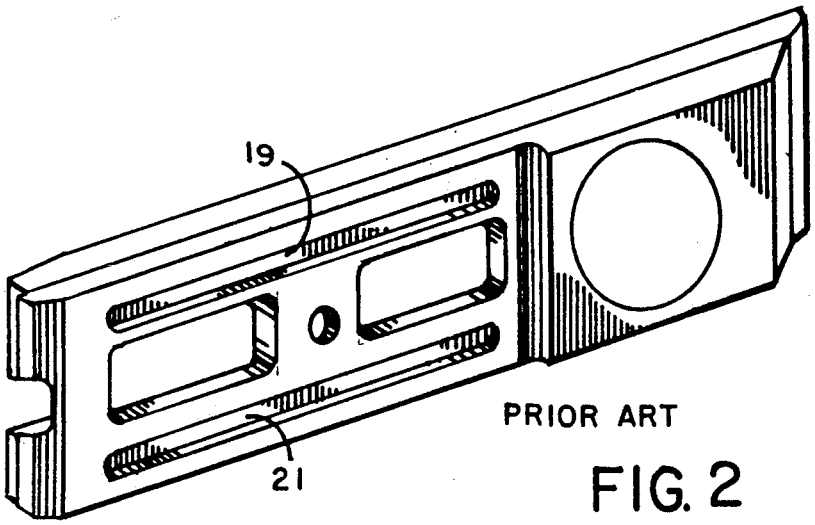
FIG. 2 illustrates a rear perspective view of the alignment guide of FIG. 1 removed from the receiver.
Figure 3A:
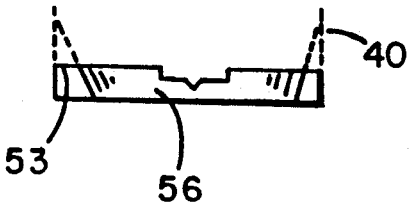

FIG. 3a illustrates a cross-sectional view through bowl 56 with the prior art bowl shown in dashed lines with its narrow edge 40 seen in contrast to the wider edge 53 of the alignment guide of this invention. At the rear of such alignment guide are machined structure-lightening slots, being first and second rear slots 19 and 21, respectively, as seen in FIG. 2, which are cut into the body to reduce its weight.

As mentioned above, it is an object of this invention not only to improve the functioning of the alignment guide by reducing stress at the bowl edge, but also to reduce its manufacturing cost as well. To this end the alignment guide of this invention, as seen in FIGS. 3 and 4, has entirely eliminated the first edge rail and second edge rail of the prior art alignment guide. Further the first body aperture of the prior art is omitted from the alignment guide of this invention. Body aperture 50 of the present invention is in the equivalent position as the second body aperture 24 of the prior art as seen in FIG. 1 and is adjacent to the portion of the body having center hole spring attachment aperture 52 defined therein. The retention spring, not shown, can be attached by a bolt screw member which screws into aperture 52 and through the spring guide into a threaded receipt pin which pin is used to engage the alignment guide in place within the receiver. Such spring guide places pressure on the ogive of each round as it passes along center slot 54. By eliminating the edge rails, their entire thickness is removed from the remainder of the body member especially around the area of the bowl such that its thickness compared to the thickness of the prior art guide is decreased by approximately 50% to approximately 0.25 inch. Bowl 56 is therefore not as deep or as wide at its top as the bowl of the prior art alignment guide. By reducing the bowl's depth, the ogive of the shell moves in and out of the bowl a shorter distance than it would in the deeper bowl of the prior art, thereby reducing the thin, sharp edge of the bowl and consequently reducing the stress concentration within the alignment guide. The wider edges 53 provide greater strength to the alignment guide of this invention. It has been found in testing that the alignment guide of this invention functions as well as that of the prior art so that the reduction in thickness and elimination of the above mentioned features does not effect the weapon's operability. At the end of the alignment guide of this invention is an arm portion 58 having a thickness of approximately 0.5 inch which arm portion allows the thinner alignment guide of this invention to have the same basic interface dimensions to be engageable into the receiver assembly of the MK-19 grenade launcher in the same fashion as the prior art alignment guide.

FIG. 4 is a rear view of the alignment guide of this invention which illustrates the elimination of the first and second rear slots of the prior art. The weight of the alignment guide of this invention is the same as that of that of the prior art due to the thinness of the alignment guide body along with the filling of the first aperture so that no lightening slots in the rear are needed. Because less machining is required to produce the alignment guide of this invention, its cost of manufacture is less than that of the prior art.

Although the present invention has been described with reference to particular embodiments, it will be apparent to those skilled in the art that variations and modifications can be substituted therefor without departing from the principles and spirit of the invention.

We claim:

1. An alignment guide for the alignment of grenade rounds in the receiver of an MK19 grenade launcher, comprising:

a solid, elongated substantially rectangular body having a right side, a left side, an upper side, a bottom side, a substantially planar front face having a right and left portion and a substantially planar rear face having a right and left portion, said front face and said rear face being parallel to one another, said front face being separated from said rear face by a distance of approximately 0.25 inch;

an arm portion extending from said left portion of said front face of said rectangular body, said arm portion having a top and said arm portion and said rectangular body having a combined total depth between said rear face and the top of said arm portion of approximately 0.5 inch;

a bowl-shaped aperture defined in said rectangular body, said bowl-shaped aperture having concave sides extending between said front face and said rear face, said bowl-shaped aperture disposed adjacent to, and at the right of, said arm portion, said bowl-shaped aperture being open at both said front face and said rear face and forming, respectively, a front bowl opening and a rear bowl opening and each of said openings having a diameter, said front bowl opening being separated from said rear bowl opening by a distance of approximately 0.25 inch, said sides of said bowl-shaped aperture being generally concave between said front bowl opening and said rear bowl opening;

a channel defined in said front face of said rectangular body, said channel having a central portion, said channel extending centrally along said front face from said right portion of said front face to said bowl-shaped aperture defined in said rectangular body;

a single body aperture, being substantially rectangular, defined in said rectangular body extending from said front face to said rear face and disposed between said bowl-shaped aperture and said right side of said rectangular body; and a screw aperture defined in said rectangular body in a central portion of said channel, said screw aperture extending between said channel and said rear face, said screw aperture positioned within said channel to the right of said body aperture.

2. The alignment guide of claim 1 wherein said diameter of said front bowl opening is greater than the diameter of said rear bowl opening, causing said bowl-shaped aperture to be disposed in a concave position, widening toward said front face and defining on said front face an upper planar edge having a substantial width and a bottom planar edge having a substantial width, said planar edges disposed, respectively, between said bowl-shaped aperture and said upper side of said rectangular body and between said bowl-shaped aperture and said bottom side of said rectangular body.

* * * * *